US005931590A

United States Patent [19]

Harris

[11] Patent Number: 5,931,590

[45] Date of Patent: Aug. 3, 1999

[54] SUN BATHING SPONGE APPLICATOR

[76] Inventor: Randall C. Harris, 1580 Schuman St., Westland, Mich. 48186

[21] Appl. No.: 09/037,567

[22] Filed: Mar. 10, 1998

[51] Int. Cl.[6] ..... A46B 5/02

[52] U.S. Cl. ..... 401/6; 401/176; 401/179

[58] Field of Search ..... 401/6, 171, 176, 401/177, 179, 197

[56] References Cited

U.S. PATENT DOCUMENTS

| | | | |
|---|---|---|---|
| D. 355,726 | 2/1995 | Delmerico | D28/7 |
| D. 360,705 | 7/1995 | Martin et al. | D28/7 |
| 3,519,364 | 7/1970 | Truhan | 401/177 |
| 4,732,503 | 3/1988 | Bader et al. | 401/176 |
| 4,934,011 | 6/1990 | Haug | 15/145 |
| 5,123,763 | 6/1992 | Simmons | 401/176 |
| 5,240,339 | 8/1993 | DeForest et al. | 401/207 |
| 5,269,037 | 12/1993 | White | 15/104 |
| 5,341,538 | 8/1994 | Banome | 15/210.1 |
| 5,573,342 | 11/1996 | Patalano | 401/6 |

*Primary Examiner*—David J. Walczak
*Attorney, Agent, or Firm*—Goldstein & Canino

[57] ABSTRACT

A sun bathing sponge applicator for applying lotion to the human body, comprises a cylindrical applicator head having an outer face connected to an elongated handle. The applicator head comprises a reservoir within the head for storing lotion and has a plurality of holes placed throughout the outer face of the head for dispensing the lotion stored in the reservoir. A sponge is affixed to the head to absorb the lotion and to facilitate even application of lotion to one's body. The sponge applicator further comprises a sliding assembly for pushing out lotion stored inside the reservoir, thereby permitting the user to selectively dispense the lotion as it is needed.

4 Claims, 2 Drawing Sheets

SUN BATHING SPONGE APPLICATOR

BACKGROUND OF THE INVENTION

The invention relates to a sun bathing sponge applicator for applying lotion to various portions of one's body. More particularly, the invention relates to a sun bathing sponge applicator which stores lotion within the reservoir of the applicator head, and selectively dispenses the lotion onto the applicator sponge affixed to the head.

Applying sun lotion to the body can be difficult and undesirable for several reasons. When alone, it is difficult to apply sun lotion to areas such as the back. In many of these areas, however, the sun's harmful rays may do the most damage if left exposed and unprotected by sun lotion. In addition, it is difficult for sunbathers to apply the sun lotion to their body without getting it all over their hands. Moreover, people generally wish to be able to apply sun lotion to the body in the shortest amount of time possible so that they can spend more time relaxing in the sun and enjoying outdoor activities rather than wasting their valuable time trying to apply the lotion.

Many types of lotion applicators have been designed in an attempt to solve the different problems and difficulties encountered in applying lotions to all parts of one's body. However, these devices have various limitations that restrict their use. Consequently, there is still a further need to provide an improved sun lotion applicator.

A number of lotion applicators have been designed which employ a removable lotion pad attached to the head of a handle. For example, U.S. Pat. No. 5,341,538 to Banome discloses a sun lotion applicator which provides a replaceable lotion pad assembly that is attached to an elongated handle. Likewise, U.S. Pat. No. 4,934,011 to Haug discloses a lotion applicator having a soft applicator pad removably mounted to an applicator handle. These devices are not desirable for sunbathers because they fail to allow the user to apply sun lotion quickly and may even increase the time necessary to apply lotion.

U.S. Pat. No. 5,240,339 to DeForest discloses a body lotion applicator employing a hollow extension arm attached directly to a conventional lotion bottle. The lotion bottle supplies the lotion through the hollow extension arm to the head of the applicator. This device is difficult to use because the lotion bottle attached to the end of the extension arm can be annoying and cumbersome when trying to apply lotion. Moreover, the hollow extension arm which fills with lotion cannot be completely emptied, thereby resulting in waste of expensive sun lotion.

While these units may be suitable for the particular purpose employed, or for general use, they would not be as suitable for the purposes of the present invention as disclosed hereafter.

SUMMARY OF THE INVENTION

It is an object of the invention to provide a sun bathing sponge applicator which is capable of reducing the amount of time necessary to apply lotion to the body.

It is another object of the invention to provide a sun bathing sponge applicator which permits the users to apply lotion without getting it all over their hands.

It is yet another object of the invention to provide a sun bathing sponge applicator which utilizes a reservoir within its applicator head to store lotion to be dispensed.

It is a further object of the invention to provide a sun bathing sponge applicator having a sliding assembly for pushing out lotion stored inside the reservoir, thereby permitting the user to selectively dispense the lotion as is needed.

It is a still further object of the invention to provide a sun bathing sponge applicator which utilizes an elongated handle to allow the user to apply lotion to various portions of the body, including hard to reach areas such as the back.

The invention is a sun bathing sponge applicator for applying lotion to the human body, comprising a cylindrical applicator head having an outer face connected to an elongated handle. The applicator head comprises a reservoir within the head for storing lotion and has a plurality of holes placed throughout the outer face of the head for dispensing the lotion stored in the reservoir. A sponge is affixed to the head to absorb the lotion and to facilitate even application of lotion to one's body. The sponge applicator further comprises a sliding assembly for pushing out lotion stored inside the reservoir, thereby permitting the user to selectively dispense the lotion as it is needed.

To the accomplishment of the above, and related objects, the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
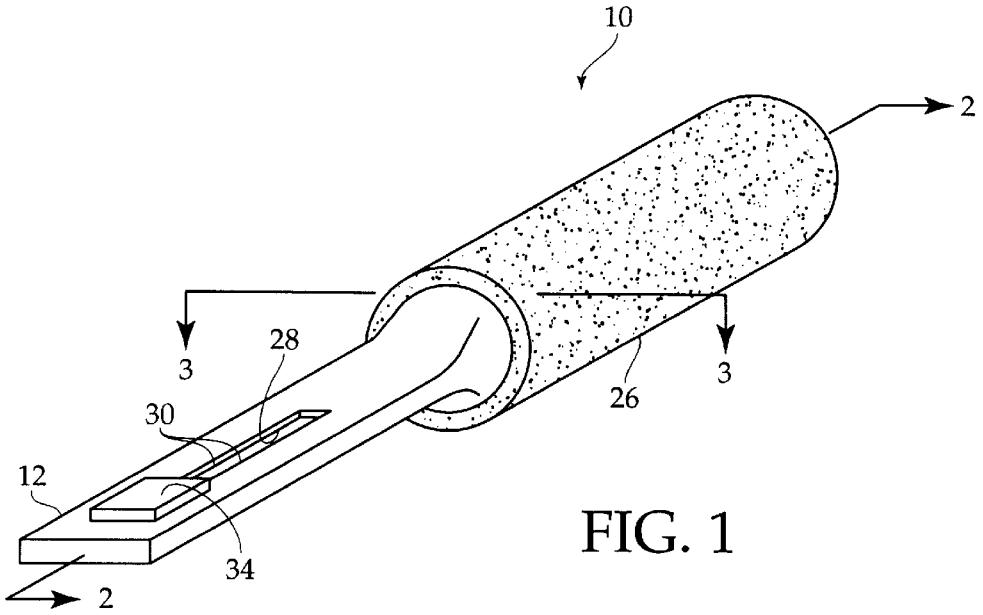
FIG. 1 is a diagrammatic perspective view of the instant invention.
Figure 2:
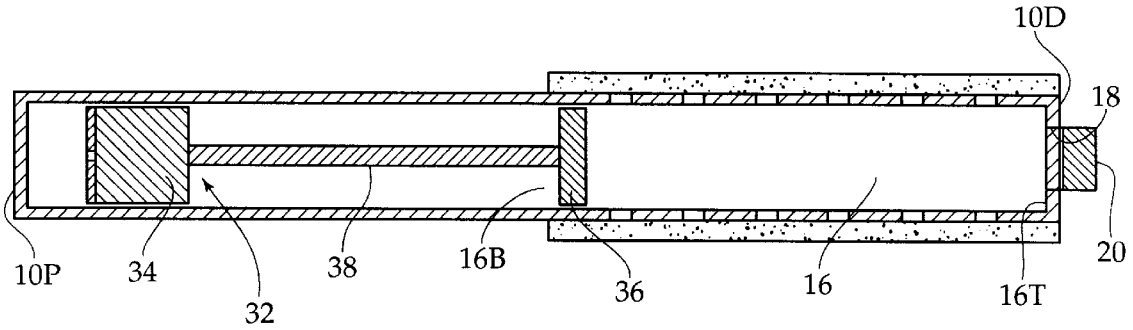
FIG. 2 is a cross-section taken along line 2—2 of FIG. 1.
Figure 3:
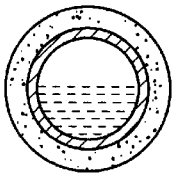
FIG. 3 is a cross-section taken along line 3—3 of FIG. 1.
Figure 4:
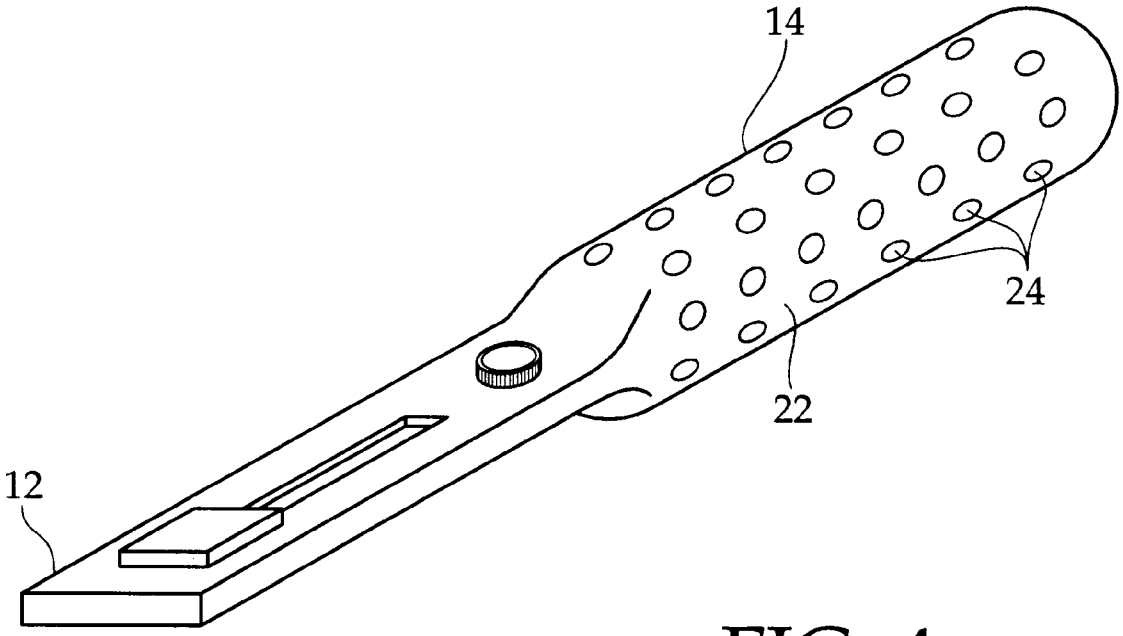
FIG. 4 is a diagrammatic perspective view of the instant invention with the washable sponge removed therefrom.

FIGS. 1, 2 and 4 illustrate a sun bathing sponge applicator 10 having a proximal end 10P and a distal end 10D. The sun bathing sponge applicator 10 includes an elongated handle 12 that is integral with a cylindrical applicator head 14. The handle 12 and the applicator head 14 is made of a rigid material such as plastic or wood.

The cylindrical applicator head 14 is provided with a reservoir 16 running the length of the head 14, which is preferably adapted to store enough lotion for at least one application to the entire body. The reservoir 16 includes a top end 16T and a bottom end 16B. The sponge applicator 10 further includes an opening 18 with a cap 20 at the distal end 10D for receiving lotion. The opening 18 is in communication with the reservoir 16.

The applicator head 14 includes an outer face 22 and a plurality of holes 24 placed throughout the outer face 22 of the head 14 for dispensing the lotion stored inside the reservoir 16. The size of each hole 24 is dependent on the viscosity of a particular lotion. It is preferably small enough to prevent dripping when pressure is not exerted against the lotion, but at the same time, big enough to allow lotion to pass through when pressure is applied.

Figure 5:
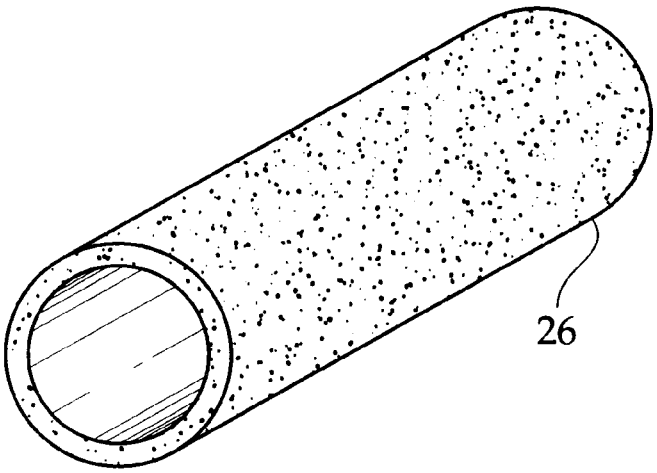
FIG. 5 is a diagrammatic perspective view of just the washable sponge.

Referring to FIGS. 1 and 5, an applicator sponge 26 is cylindrical to conform to the size and shape of the head and fits snugly over the applicator head 14. The sponge 26 covers essentially all the holes 24, thereby absorbing the lotion as it is dispensed through the holes. The sponge 26 preferably is made of washable material and can be removed for cleaning or for replacement by another sponge. The sponge 26 is affixed to the applicator head by means of an elastic band, by friction, or by any other fastening means as would be appreciated by those skilled in the art.

The elongated handle 12 is provided with a length that will enable the user to reach all parts of one's body, including the back. As shown in FIGS. 1 and 2, the handle 12 has a rectangular cross-section and includes a top side and a bottom side. The handle 12 includes a channel 28 extending along the length thereof. The channel is defined by longitudinal sides 30 and is formed on and through the top side of handle 12.

To permit selective dispensing of lotion, a slide assembly 32 is slidably mounted in the channel 28 for pushing out the lotion. The slide assembly 32 comprises a slide button 34 which has a pair of opposed slots which slidably engage on the longitudinal sides 30 of the channel 28. The slide button 34 allows the user to operate the slide assembly 32. The slide assembly 32 further comprises a piston 36 which is connected to an extension arm 38 at one end. The other end of the extension arm 38 is connected to the slide button 34. The piston 36, which is round, has substantially the same diameter as that of the lotion reservoir 16, thereby providing a tight seal to prevent lotion from backing up.

The piston 36 of the slide assembly 32 is capable of traveling across substantially the entire length of the reservoir 16. For instance, when the slide button 34 is pulled back fully toward the proximal end 10P of the applicator 10, the piston 36 is positioned at the bottom end 16B of the reservoir 16. Similarly, when the slide button 34 is pushed forward fully toward the distal end 10D of the applicator 10, the piston 36 is touching the top end 16T the reservoir 16.

In use, lotion from a dispensing bottle is poured manually through the opening 18 into the lotion reservoir 16 of the applicator 10. As the slide button 34 is pushed forward toward the distal end 10D, the lotion is pushed out of the lotion reservoir 16 through the holes 24 and is absorbed by the applicator sponge 26. Lotion absorbed in the applicator sponge 26 can be applied to any portion of the body.

Unused lotion inside the applicator 10 can be poured back into the dispensing bottle through the opening 18. When trying to empty the reservoir 16 of lotion, the slide assembly 32 can be used to squeeze out any unused lotion. The relative size of the opening 18 is such that the lotion will mainly flow out of the opening 18 rather than go through the much higher resistance holes 24.

The slide assembly 32 serves dual functions. When the opening 18 is closed with the cap 20, the slide assembly 32 serves as a means for selectively dispensing lotion through the plurality of holes 24. Whereas, when the opening 18 is not sealed with the cap, the slide assembly 32 serves as a means for squeezing out any unused lotion back into the original lotion bottle.

Many specific details contained in the above description merely provide illustration of some preferred embodiments and should not be construed as a limitation on the scope of the invention. Many other variations are possible. For example, the shape of the applicator head and the length of the handle can vary depending on its specific use and on the size of its intended user. In addition, this apparatus is not limited to use with sun lotions only, but can be used to apply any other flowable substances to human body.

What is claimed is:

1. A sun bathing sponge applicator, for applying lotion to the human body, comprising:

a) an applicator head, said head having a reservoir for storing lotion, said head also having an opening with a cap for receiving lotion, said opening being in communication with said reservoir, said head also having an outer face having a plurality of holes for dispensing lotion stored in said reservoir;

b) an elongated handle connected to the applicator head;

c) an applicator sponge affixed to said applicator head, said sponge corresponding substantially to the size and shape of said applicator head and covering essentially all the holes, whereby said sponge absorbs the lotion dispensed through the holes; and d) a selective dispensing means for pressurizing lotion stored inside said reservoir, thereby allowing selective dispensing of lotion through the holes.

2. The sun bathing sponge applicator of claim 1, wherein the applicator head has an overall cylindrical shape.

3. The sun bathing sponge applicator of claim 2, wherein the elongated handle further comprises a top side, a channel being formed on and through said top side.

4. The sun bathing sponge applicator of claim 3, wherein the selective dispensing means further comprises:

a) a slide button slidably mounted in the channel;

b) a piston slidably mounted within the head; and c) an extension arm having two ends, one end attached to the piston, and the other end attached to the slide button.

* * * * *